United States Patent [19]

Speil

[11] Patent Number: 4,708,103

[45] Date of Patent: Nov. 24, 1987

[54] HYDRAULIC VALVE CLEARANCE COMPENSATION DEVICE

[75] Inventor: Walter Speil, Ingolstadt, Fed. Rep. of Germany

[73] Assignee: Motomak Motorenbau, Maschinen- und Werkzeugfabrik, Konstruktionen GmbH, Ingolstadt, Fed. Rep. of Germany

[21] Appl. No.: 869,432

[22] Filed: Jun. 2, 1986

[30] Foreign Application Priority Data

Nov. 21, 1985 [DE] Fed. Rep. of Germany ..... 3541198

[51] Int. Cl.[4] ..... F01L 1/18

[52] U.S. Cl. ..... 123/90.46; 123/90.55

[58] Field of Search ..... 123/90.49, 90.27, 90.45, 123/90.46, 90.52, 90.55

[56] References Cited

U.S. PATENT DOCUMENTS

| | | | |
|---|---|---|---|
| 2,051,313 | 8/1936 | Olenick | 123/90.39 |
| 4,291,652 | 9/1981 | Trzoska | 123/90.6 |
| 4,494,729 | 1/1985 | Kruger | 123/90.44 |
| 4,570,582 | 2/1986 | Speil | 123/90.46 |

FOREIGN PATENT DOCUMENTS

| | | | |
|---|---|---|---|
| 1179763 | 10/1964 | Fed. Rep. of Germany | 123/90.45 |
| 3118466 | 11/1982 | Fed. Rep. of Germany . | |
| 1369597 | 10/1974 | United Kingdom | 123/90.39 |

*Primary Examiner*—Craig R. Feinberg
*Assistant Examiner*—David A. Okonsky
*Attorney, Agent, or Firm*—Bierman & Muserlian

[57] ABSTRACT

A hydraulic valve clearance compensation element comprising a hydraulic compensation element (2) in a bore of a rocker arm (1) or similar actuating mechanism extending coaxially from a stem (4) of an engine valve, a longitudinally moveable, adjusting piston (3) ending towards the valve stem (4) in a spherical projection (5) and between said projection and the end face (6) of the valve stem (4) a guide shoe (7,14) is arranged, comprising, on the one hand, a spherical cavity (8) which engages the spherical projection (5) of the adjusting piston (3) and, on the other hand, being supported with a plane surface (9) on the end face (6) of the valve stem (4), characterized in that, on the adjusting piston (3), a cage portion (11) emanates from a location situated behind the spherical projection (5), and extends in the direction of the valve stem (4) and ends there in radially inwardly directed locating zones (13), which engage behind an outer surface (15) of the guide shoe (7,14) and projections (10), respectively, of this surface so that the guide shoe is securely held onto adjusting piston (3) while being angularly freely moveable to said piston.

6 Claims, 2 Drawing Figures

Figure 1:
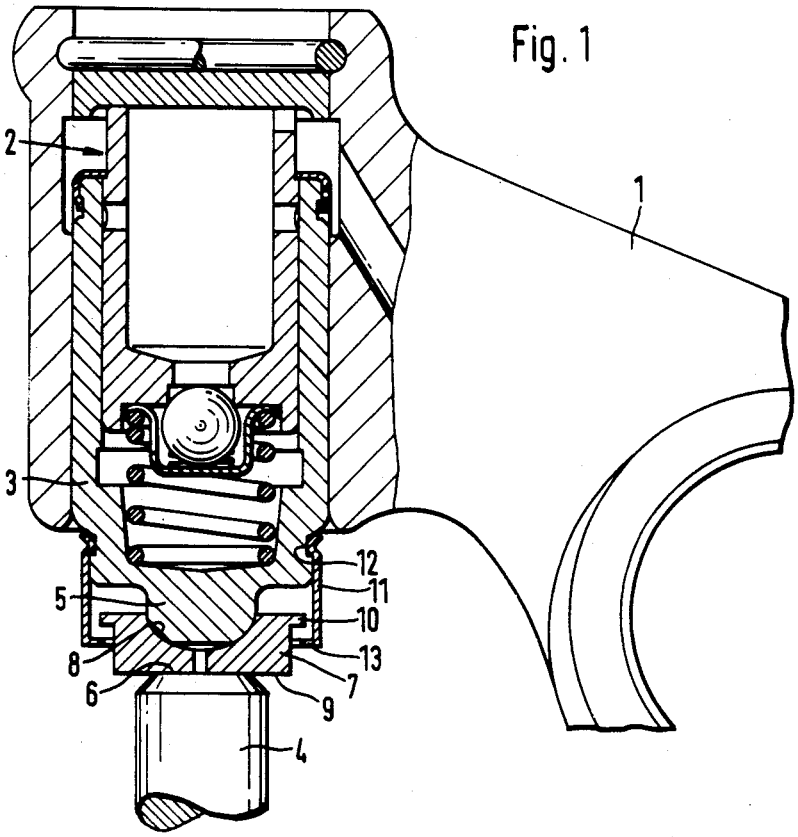

1
2
3
4
5
6
7
8
9
10
11
12
13

HYDRAULIC VALVE CLEARANCE COMPENSATION DEVICE

STATE OF THE ART

Hydraulic valve clearance compensation elements comprising an hydraulic compensation element in a bore of a rocker arm or similar acting device extending coaxially from a stem of an engine valve, a longitudinally moveable adjusting piston ending towards the valve stem in a spherical projection and provided with a guide shoe between said projection and end face of the valve stem, said guide shoe having a spherical cavity which engages the spherical projection of the adjusting piston and being supported with a plane surface on the end face of the valve stem are known.

The guide shoes in the known embodiments act to create contact surfaces between the adjusting piston on the one hand and the valve stem on the other hand whereby wear and tear is reduced and lubrication conditions are improved. In German patent application DE-OS No. 3,118,466, such a guide shoe is simply inserted between the spherical cavity of the adjusting piston and the surface of the valve stem and it is held in position during operation by the cooperation of the spherical projection and the spherical cavity. However, during disassembly of the rocker arms, there is the danger that the guide shoe will fall into the engine block from which it can be removed only with great difficulty.

German patent application DE-OS No. 3,304,398 describes another embodiment wherein the guide shoe is provided with a safety device against such a fall wherein it is provided with a flange engaging a groove about the valve stem. In this manner, the shoe is securely fastened to the end of the valve stem even during disassembly of the rocker arms and can not be lost. The disadvantage of this solution is that the manufacturer must keep different valves in stock if in addition to hydraulic valve clearance compensation elements, he also manufactures mechanical valve clearance compensation elements.

Mounting supports for such guide shoes have also already been proposed which are to be seen as kind of reverse of the above embodiment, namely the guide shoe by means of a flange engages behind a diameter reduction of the spherical projection of the adjusting piston. However, this requires that the spherical projection on the adjusting piston be markedly lengthened to create the axially required space for this diameter reduction. In many cases, however, this additionally required length is not available.

OBJECTIONS OF THE INVENTION

It is an object of the invention to create a secure mounting support for the guide shoe on the hydraulic valve clearance, compensating element without requiring a lengthening of the adjusting piston, and without requiring modifications to the valve stem.

This and other objects and advantages of the invention will become obvious from the following detailed description.

THE INVENTION

The hydraulic valve clearance compensation element of the invention is comprised of a hydraulic compensation element (2) in a bore of a rocker arm (1) or similar actuating mechanism extending coaxially from a stem (4) of an engine valve, a longitudinally moveable, adjusting piston (3) ending towards the valve stem (4) in a spherical projection (5) and between said projection and the end face (6) of the valve stem (4) a guide shoe (7,14) is arranged, comprising, on the one hand, a spherical cavity (8) which engages the spherical projection (5) of the adjusting piston (3) and, on the other hand, being supported with a plane surface (9) on the end face (6) of the valve stem (4), characterized in that, on the adjusting piston (3), a cage portion (11) emanates from a location situated behind the spherical projection (5), and extends in the direction of the valve stem (4) and ends there in radially inwardly directed locating zones (13), which engage behind an outer surface (15) of a guide shoe (7,14) and projections (10), respectively, of this surface so that the guide shoe is securely held onto adjusting piston (3) while being angularly freely moveable to said piston.

The problem is solved by the invention in that on the adjusting piston, from a location behind the spherical projection, a cage portion emanates so that it extends in the direction of the valve stem and ends there in radially inwardly directed locating zones which engage from behind the outer surface of the guide shoe and the projections of this surface, respectively, in such a manner that the guide shoe is held securely to the adjusting piston while being angularly freely moveable to said piston.

Figure 2:
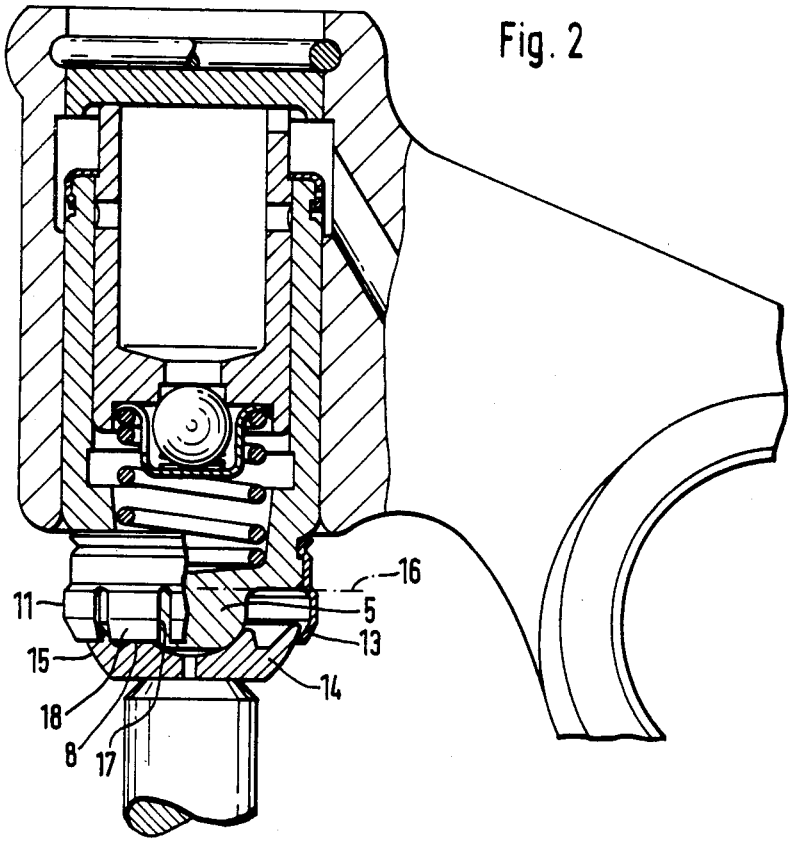

Referring now to the drawings:

FIGS. 1 and 2 are longitudinal cross-sections through two different elements of the invention.

In FIG. 1, a hydraulic valve clearance compensation element 2 rests in rocker arm 1 in a known manner with the former's adjusting piston 3 ending in a spherical projection 5 at its end facing the valve stem 4. Between this spherical projection 5 and the end face 6 of valve stem 4, guide shoe 7 is arranged so that its spherical cavity 8 engages spherical projection 5 of adjusting piston 3, and whose plane surface 9 interacts with face 6 of valve stem 4.

At its end facing towards the adjusting piston 3, the outer surface of guide shoe 7 has a radially projecting collar 10. To secure it to the adjusting piston 3, a cage portion 11 is at its upper end molded into peripheral groove 12. At its lower end, the cage portion 11 is drawn into locating zones 13 which are on an inside diameter that is smaller than the diameter of the collar 10. The distance of the locating zones 13 from the collar 10 in the axial direction is selected so that guide shoe 7 can swivel during the angular motions occurring during operation. In this manner, a secure mounting of guide shoe 7 is assured without its free movement being impaired by any adjoining components.

The variant of the invention shown in FIG. 2 differs from FIG. 1 only in that guide shoe 14 is provided with an outer surface 15 which is in the shape of a portion of a spherical surface, the center of which coincides with the center of spherical projection 5 and the cage portion (11), starting from the end at which it is drawn into a reduced diameter, is provided over a portion of its length with several elongated slots (17) distributed over its area resulting in individual retaining tongues (18). The locating zones 13 of cage portion 11 end below the transverse plane 16 passing through the center of the spherical projection whereby a secure mounting of guide shoe 14 as well as its free angular mobility are assured.

To perform the desired function, it is not absolutely necessary that collar 10 or spherical surface 15 extend over the entire area of the guide shoe. Rather, it is sufficient if, e.g., three projections are provided, each staggered by 120°. The same applies analogously to locating zones 13 of cage portion 11.

Various modification of the element of the invention may be made without departing from the spirit or scope thereof and it is to be understood that the invention is intended to be limited only as defined in the appended claims.

What I claim is:

1. A hydraulic valve clearance compensation element comprising a hydraulic compensation element (2) in a bore of a rocker arm (1) or similar actuating mechanism extending coaxially from a stem (4) of an engine valve, a lonitudinally moveable adjusting piston (3) ending towards the valve stem (4) in a spherical projection (5) and between said projection and an end face (6) of the valve stem (4) a guide shoe (7,14) is arranged, comprising, on one side, a spherical cavity (8) which engages the spherical projection (5) of the adjusting piston (3) and, on an opposite side, being supported with a plane surface (9) on the end face (6) of the valve stem (4), characterized in that a cage portion (11) extends from the adjusting piston in a direction towards the valve stem (4) and ends adjacent the end face of the valve stem with radially inwardly directed locating portions (13), said portions juxtaposed about an outer surface (15) of the guide shoe (7,14) so that the guide shoe is securely held by the adjusting piston (3) and cage portion while being angularly freely moveable with respect to said piston.

2. A valve clearance compensation element of claim 1 wherein the outer surface (15) of the guide shoe (14) is in the shape of a portion of a spherical surface, the center of which coincides with the center of the spherical cavity (8), and that a cage portion (11) extends beyond a transverse plane (16) that passes through the center of the spherical cavity and locating portions (13) are situated on a diameter that is smaller than the diameter of spherical surface (15) of the guide shoe (14).

3. A valve clearance compensation element of claim 1 wherein the cage portion (11) is in the shape of an essentially cylindrical component which, for its securing to adjusting piston (3) engages a peripheral groove (12) in the adjusting piston (3), and at an opposite end is drawn into a reduced diameter.

4. A valve clearance compensation element of claim 3 wherein cage portion (11), starting from the end at which it is drawn into a reduced diameter, is provided over a portion of its length with several elongated slots distributed over its area resulting in individual retaining tongues.

5. A valve clearance compensation element of claim 2 wherein the cage portion (11) is in the shape of an essentially cylindrical component which, for its securing to adjusting piston (3) engages a peripheral groove (12) in the of adjusting piston (3), and at an opposite end is drawn into a reduced diameter.

6. A valve clearance compensation element of claim 5 wherein cage portion (11), starting from the end at which it is drawn into a reduced diameter, is provided over a portion of its length with several elongated slots distributed over its area resulting in individual retaining tongues.

* * * * *